US007204091B2

(12) United States Patent
Allison et al.

(10) Patent No.: US 7,204,091 B2
(45) Date of Patent: Apr. 17, 2007

(54) MAINTENANCE AND CLEANING FOR AN ICE MACHINE

(75) Inventors: Matthew W. Allison, Mundelein, IL (US); Daniel Alan Jaszkowski, Racine, WI (US); Garth Kurt Pearson, Lake Bluff, IL (US)

(73) Assignee: Scotsman Ice System, Vernon Hills, IL (US)

( * ) Notice: Subject to any disclaimer, the term of this patent is extended or adjusted under 35 U.S.C. 154(b) by 21 days.

(21) Appl. No.: 11/049,007

(22) Filed: Feb. 2, 2005

(65) Prior Publication Data

US 2005/0166612 A1 Aug. 4, 2005

Related U.S. Application Data

(60) Provisional application No. 60/541,544, filed on Feb. 3, 2004.

(51) Int. Cl.
*F25C 1/00* (2006.01)

(52) U.S. Cl. ..... 62/66; 62/233; 62/303; 62/158

(58) Field of Classification Search ..... 62/66–74, 62/303, 340–356, 233, 135–137, 129, 158; 165/11.1–11.2
See application file for complete search history.

(56) References Cited

U.S. PATENT DOCUMENTS

| | | | | |
|---|---|---|---|---|
| 3,733,840 | A * | 5/1973 | Pearl et al. | 62/78 |
| 4,850,202 | A * | 7/1989 | Kito et al. | 62/195 |
| 5,237,837 | A * | 8/1993 | Naruse et al. | 62/434 |
| 6,311,501 | B1 * | 11/2001 | Allison et al. | 62/74 |
| 6,725,675 | B2 * | 4/2004 | Kampert et al. | 62/71 |

* cited by examiner

*Primary Examiner*—William E. Tapolcai
(74) *Attorney, Agent, or Firm*—Ohlandt, Greeley, Ruggiero & Perle, L.L.P.

(57) ABSTRACT

An ice-making machine and method of maintaining and cleaning an ice-making machine are provided. The ice-making machine has predictive maintenance and cleaning. Operational conditions of the ice-making machine, such as, for example, water quality, are used to establish service intervals and/or types of service, and the service intervals and/or types of service are indicated to the user with a lead-time to allow for timely obtaining the service.

20 Claims, 1 Drawing Sheet

MAINTENANCE AND CLEANING FOR AN ICE MACHINE

RELATED APPLICATIONS

This application claims priority in co-pending U.S. Provisional Application No. 60/541,544, filed on Feb. 3, 2004, the disclosure of which is incorporated herein by reference.

BACKGROUND OF THE INVENTION

1. Field of the Invention

This invention relates generally to an ice-making machine or ice cube maker and, more particularly, to maintenance and cleaning of the ice-making machine.

2. Description of the Related Art

Ice-making machines require cleaning and maintenance over time. Typical ice-making machines do not have any means of notifying a user when cleaning or maintenance is required. Such machines are cleaned when they get to a point when they are no longer functioning properly.

This type of maintenance and cleaning of typical ice-making machines fails to consider many of the variables associated with the timing requirement of cleaning and maintenance of the ice-making machines. This can be detrimental to the ice-making machine where components or parts are damaged due to continued use under such conditions, and can be costly where an ice-machine is receiving cleaning and maintenance when none is required. Accordingly, there is a need to improve the cleaning and maintenance of ice-making machines. There is a further need to provide predictive maintenance and cleaning for ice-making machines. There is still another need to provide dynamic maintenance and cleaning for ice-making machines.

SUMMARY OF THE INVENTION

The present invention provides an ice-making machine or ice-cube maker that utilizes predictive maintenance and cleaning. The service interval for the ice-making machine can be determined from one or more operating factors or conditions, and/or combinations of those operating conditions. The ice-making machine can determine the service interval based upon the quality of the water used to form the ice, including, but not limited to, the water conductivity and/or the total dissolved solid content. A sensor can be used to measure the water quality. An indicator may be used to notify the user that a service interval/requirement has been established. The indicator can be visible and/or audible, and may be actuated with a lead-time as compared to the scheduled service interval/requirement. The lead-time may be factory set or can be selected by the user.

The present invention also provides a method of cleaning and maintaining an ice-making machine. The method includes predictive cleaning and maintenance based at least in part upon operational factors or conditions of the ice-making machine, such as, for example, water quality. The service interval can be set based upon a derived fixed time period calculated from the measurement of the particular operational condition(s), an algorithm which utilizes the measurement to establish a variable service interval, or a combination of both. The service interval can be indicated to the user with a lead-time allowing the user to obtain the necessary service, and can also indicate a type of service, such as, for example, de-scaling or sanitation, which is necessary.

The present invention also provides for automatic service of the ice-making machine by an automatic service system that is operably connected to the ice-making machine. The automatic service is actuated based at least in part upon one or more of the operational conditions of the ice-making machine, which are being monitored. A pre-determined level of the one or more operational conditions can be used to trigger the actuation of the automatic service. The pre-determined level can be factory-set, user selected, or can be dynamically set by a microprocessor or other device based at least in part upon one or more of the other operational conditions.

The actuation of the automatic service can be indicated to the user by visual, audio or both, types of signals or alerts. Additionally, the ice-making machine can monitor its operational conditions and use a combination of automatic self-service with scheduling of manual service in order to fully maintain itself.

The scheduling of the service can be communicated directly to a service provider. For example, a service center may receive a scheduling signal from the ice-making machine and the service center can then communicate with a repair-person and/or a parts supplier. Additionally, the ice-making machine may communicate directly with one or more of these service providers described above. The communication between the ice-making machine and the one or more service providers can be through various mediums, such as, for example, wired and wireless modems, wired and wireless telephone, internet and cable.

Other characteristics and advantages of the invention shall become clearer from the description of a preferred but not exclusive embodiment of the ice maker according to the invention, illustrated for purposes of understanding and non-limiting in the appended drawings, in which:

DESCRIPTION OF THE INVENTION

Figure 1:
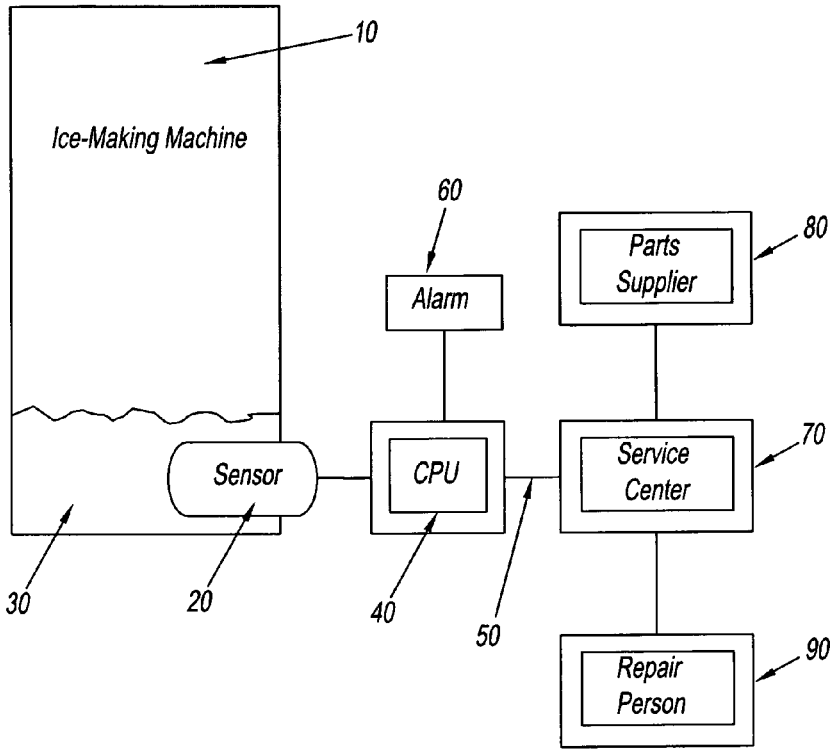
FIG. 1 shows a schematic representation of an ice-making machine according to the present invention.

The ice-making machine and the method of maintaining and cleaning the ice-making machine of the present invention provide predictive cleaning and maintenance based at least in part upon one or more operational factors or conditions of the ice-making machine. In a preferred embodiment, predictive cleaning and maintenance is based upon the operational condition of the quality of the water that is used to make the ice in the ice-making machine. However, the present disclosure contemplates the use of other operational conditions or combinations of conditions to establish cleaning and maintenance for the ice-making machine. The ice-making machine of the present invention can include typical known ice-making components, such as, for example, condenser, compressor, evaporator and interconnection structure.

In the present invention, the quality of the water for the ice-making machine can be determined and a service interval can then be established based upon this information. In the preferred embodiment, a sensor is used to determine the quality of water. However, the present disclosure contemplates the use of other devices and methodologies for determining the quality of the water and/or any other operating condition for establishing the service interval. The quality of water can be determined from a variety of different factors used together or individually. Preferably, the ice-making machine determines the water quality based upon the water conductivity or the total dissolved solid content.

The service interval that is established can be based upon a calculation of a fixed time period dependent upon the measurement of the water quality. The service interval can also be based upon an algorithm that utilizes the measurement of the water quality to calculate a service schedule, such as, for example, a continuously variable maintenance interval based upon the measurement. Additionally, the service interval can be a combination of the calculated fixed time period and the variable time period.

The determination of the service interval is also preferably in communication with an indicator that notifies the user that maintenance is required. The indicator can be visible, audible, or both and can be on an outside of the ice-making machine to facilitate notification to the user. The sensor, other detection device or methodology, and the indicator may also further notify the user of the type of service that is required, such as, for example, de-scaling or sanitation. The indication of the type of service needed can be done through a variety of different ways, such as, for example, visual display. Preferably, the indicator is actuated at a period of time prior to the actual time that maintenance is required to allow the user time to schedule and obtain the service. This period of time can be factory set or can be selected by the user.

Additionally, while the present specification describes the determination of a service interval based upon one or more operational conditions of the ice-making machine, the present disclosure contemplates the determination of timing for all types of servicing of the ice-making machine, including automatic.

The ice-making machine of the present invention can use one or more of its operational conditions to select one or more services that rare to be performed and also to automatically actuate those service. This is done by way of an automatic service system that is operably connected to the ice-making machine and its various components, such as, for example, a self-sanitizing device or a self-de-scaling device.

Actuation of the one or more automatic services can also be combined with scheduling of a manual service as described above. The ice-making machine provides indication to the user via visual, audio or both types of alerts, of the actuation or pending actuation of an automatic service, as well as the scheduling of a manual service.

Referring to FIG. 1, the ice-making machine of the preferred embodiment provides for communication of the service signal to a remote location. The ice-making machine 10 is operably connected to the sensor 20 for detecting and determining the operation conditions of the machine. In the embodiment shown, the sensor 20 is monitoring the water 30 of the ice-making machine 10 with respect to the operational conditions and the pre-determined levels for those operational conditions. The sensor 20 is in communication with the microprocessor 40. The microprocessor 40 can receive data from the sensor 20 and monitor that raw data (through various algorithms and other monitoring processes) to determine the operational conditions of the ice-making machine 10 or the sensor can provide refined data that is indicative of the operational conditions of the ice-making machine.

The microprocessor 40 can have an indicator, alarm or alert 60 that is actuated based upon reaching the predetermined level of the particular operational condition that is being monitored. In the present disclosure, the predetermined level of the particular operational condition can be factory set, selected by the user or dynamically set, such as, for example, by the microprocessor based upon one or more of the other operational conditions of the ice-making machine.

The microprocessor 40 can be in communication with a remote location for scheduling of a manual service or for monitoring the service and providing assistance, such as, for example, supplying replacement parts. In the embodiment shown in FIG. 1, the microprocessor is in communication with a service center 70 via the internet 50, although other mediums for communication can also be used, such as, for example, wired and wireless modems, wired and wireless telephone, or cable.

The service center 70 can then directly communicate with a parts supplier 80 and/or a repair person 90. However, the present disclosure contemplates direct communication between the ice-making machine 10 and one or more of all of these service providers 70, 80, 90.

The dynamic maintenance and cleaning of the ice-making machine of the present invention provides the advantage of minimizing down-time by allowing the scheduling of necessary service to the ice-making machine rather than having an unexpected service during a busy time of operation. Additionally, the ice-making machine and method of the present invention that provides predictive cleaning and maintenance minimizes unnecessary service, while assuring reliable performance and preventing unnecessary wear on the ice-making machine.

The present invention having been thus described with particular reference to the preferred forms thereof, it will be obvious that various changes and modifications may be made therein without departing from the spirit and scope of the present invention as defined herein.

What is claimed is:

1. An ice-making machine comprising:

a compressor, a condenser, an evaporator, and a sensor, wherein said sensor determines an operational condition of the ice-making machine, and a microprocessor that schedules a service based at least in part when said operational condition reaches a predetermined level and on a service interval derived from said operational condition.

2. The ice-making machine of claim 1, wherein said operational condition is a quality of water supplied to the ice-making machine.

3. The ice-making machine of claim 2, wherein said sensor measures water conductivity.

4. The ice-making machine of claim 2, wherein said sensor measures a total dissolved solid content of said water.

5. The ice-making machine of claim 1, further comprising an indicator in communication with said sensor, wherein said indicator notifies a user of scheduling of said service.

6. The ice-making machine of claim 5, wherein said indicator is a visual indicator.

7. The ice-making machine of claim 5, wherein said indicator is an audio indicator.

8. The ice-making machine of claim 1, further comprising an automatic service system operably connected to the ice-making machine that provides said service to the ice-making machine automatically.

9. The ice-making machine of claim 8, wherein said microprocessor is in communication with said automatic service system and said sensor, wherein said service is a plurality of services, and wherein one or more of said plurality of services can be automatically actuated by said microprocessor.

10. The ice-making machine of claim 8, further comprising an indicator in communication with said sensor, wherein said indicator notifies a user of actuation of said automatic service.

11. A method of servicing an ice-making machine comprising:

determining an operational condition of the ice-making machine; and scheduling a service of the ice-making machine based at least in part when said operational condition reaches a pre-determined level and on a service interval derived from said operational condition.

12. The method of claim 11, wherein said operational condition is a quality of water supplied to the ice-making machine.

13. The method of claim 11, wherein said operational condition is determined by measuring water conductivity.

14. The method of claim 12, wherein said operational condition is determined by measuring a total dissolved solid content of said water.

15. The method of claim 11, further comprising; notifying a user of the scheduling of the service.

16. The method of claim 15, wherein the user is notified visually.

17. The method of claim 15, wherein the user is notified audibly.

18. The method of claim 11, further comprising:

determining a type of service required by the ice-making machine based at least in part upon said operational condition.

19. The method of claim 18, further comprising: notifying a user of the type of service required by the ice-making machine.

20. The method of claim 11, further comprising:

automatically providing the service to the ice-making machine via an automatic service system operably connected to the ice-making machine.

* * * * *